US007193565B2

(12) United States Patent
Caimi et al.

(10) Patent No.: US 7,193,565 B2
(45) Date of Patent: Mar. 20, 2007

(54) MEANDERLINE COUPLED QUADBAND ANTENNA FOR WIRELESS HANDSETS

(75) Inventors: Frank M. Caimi, Vero Beach, FL (US); Gregory A. O'Neill, Jr., Rockledge, FL (US)

(73) Assignee: SkyCross, Inc., Viera, FL (US)

( * ) Notice: Subject to any disclaimer, the term of this patent is extended or adjusted under 35 U.S.C. 154(b) by 0 days.

(21) Appl. No.: 11/145,171

(22) Filed: Jun. 3, 2005

(65) Prior Publication Data

US 2005/0270243 A1 Dec. 8, 2005

Related U.S. Application Data

(60) Provisional application No. 60/577,328, filed on Jun. 5, 2004.

(51) Int. Cl.
*H01Q 1/38* (2006.01)

(52) U.S. Cl. ..... 343/700 MS; 343/702; 343/895; 343/846

(58) Field of Classification Search ..... 343/700 MS, 343/702, 846, 895
See application file for complete search history.

(56) References Cited

U.S. PATENT DOCUMENTS

| | | | |
|---|---|---|---|
| 3,736,534 | A | 5/1973 | Chaffee |
| 3,742,393 | A | 6/1973 | Karp |
| 3,899,757 | A | 8/1975 | Nakagami |
| 3,925,738 | A | 12/1975 | Bates et al. |
| 4,293,858 | A | 10/1981 | Hockham |
| 4,435,689 | A | 3/1984 | McDowell |
| 4,465,988 | A | 8/1984 | Moats |
| 5,754,143 | A | 5/1998 | Warnagiris |
| 5,790,080 | A | 8/1998 | Apostolos |
| 5,867,126 | A | 2/1999 | Kawahata et al. |
| 5,892,490 | A | 4/1999 | Asakura et al. |
| 5,936,587 | A | 8/1999 | Gudilev et al. |
| 5,949,303 | A | 9/1999 | Arvidsson et al. |
| 5,995,006 | A | 11/1999 | Walsh |
| 6,028,564 | A | 2/2000 | Duan et al. |
| 6,028,567 | A | 2/2000 | Lahti |
| 6,094,170 | A | 7/2000 | Peng |
| 6,218,992 | B1 | 4/2001 | Sadler et al. |
| 6,285,342 | B1 | 9/2001 | Brady et al. |
| 6,304,222 | B1 | 10/2001 | Smith et al. |
| 6,323,814 | B1 | 11/2001 | Apostolos |
| 6,388,626 | B1 | 5/2002 | Gamalielsson et al. |
| 6,404,391 | B1 | 6/2002 | Apostolos |
| 6,469,675 | B1 | 10/2002 | Jo et al. |

(Continued)

OTHER PUBLICATIONS

Harvey, A. F.; "Periodic and Guding Structures at Microwave Frequencies"; IRE Transactions on Microwave Theory Techniques; Jan. 1960; pp. 30-61.

*Primary Examiner*—Hoang V. Nguyen
(74) *Attorney, Agent, or Firm*—John L. DeAngelis; Beusse Wolter Sanks Mora & Maire, P.A.

(57) ABSTRACT

An antenna operative in a plurality of frequency bands. The antenna comprises first and second high band resonators, a resonating meanderline and a counterpoise. A ground return conductively couples one or more regions of the counterpoise to the meanderline. One or more of the first resonating element, the second resonating element and the resonating meanderline are coupled by magnetic and/or capacitive coupling to provide operation in the plurality of frequency bands.

34 Claims, 3 Drawing Sheets

U.S. PATENT DOCUMENTS 6,504,508 B2 1/2003 Apostolos
6,597,321 B2 7/2003 Thursby et al.
6,707,428 B2 * 3/2004 Gram ..... 343/700 MS
6,741,213 B2 * 5/2004 Jenwatanavet ..... 343/700 MS
2001/0048394 A1 12/2001 Apostolos
2005/0110692 A1 * 5/2005 Andersson ..... 343/702

* cited by examiner

MEANDERLINE COUPLED QUADBAND ANTENNA FOR WIRELESS HANDSETS

REFERENCE TO RELATED APPLICATIONS

This application claims the benefit of the provisional patent application entitled Meanderline Coupled Quadband Antenna for Wireless Handsets filed on Jun. 5, 2004, and assigned application No. 60/577,328.

FIELD OF THE INVENTION

The present invention relates generally to antennas and more specifically to an antenna employing meanderlines and operating in a plurality of frequency bands.

BACKGROUND OF THE INVENTION

It is generally known that antenna performance is dependent on the size, shape and material composition of the constituent antenna elements, as well as the relationship between certain antenna physical parameters (e.g., length for a linear antenna and diameter for a loop antenna) and the wavelength of the signal received or transmitted by the antenna. These relationships determine several antenna operational parameters, including input impedance, gain, directivity, signal polarization, operating frequency, bandwidth and radiation pattern. Generally for an operable antenna, the minimum physical antenna dimension (or the electrically effective minimum dimension) must be on the order of a half wavelength (or a multiple thereof) of the operating frequency, which thereby advantageously limits the energy dissipated in resistive losses and maximizes the transmitted energy. Alternatively, a quarter-wavelength antenna operating over a ground plane performs similarly to a half-wavelength antenna. Quarter-wavelength and half-wavelength antennas are the most commonly used.

The burgeoning growth of wireless communications devices and systems has created a substantial need for physically smaller, less obtrusive, and more efficient antennas that are capable of wide bandwidth or multiple frequency-band operation, and/or operation in multiple modes (e.g., selectable radiation patterns or selectable signal polarizations). Smaller packaging of state-of-the-art communications devices, such as cellular handsets and personal digital assistants, do not provide sufficient space for the conventional quarter and half wavelength antenna elements. Thus physically smaller antennas operating in the frequency bands of interest and providing the other desirable antenna operating properties (input impedance, radiation pattern, signal polarizations, etc.) are especially sought after.

As is known to those skilled in the art, there is a direct relationship between physical antenna size and antenna gain, at least with respect to a single-element antenna, according to the relationship: gain=(βR)^2+2βR, where R is the radius of the sphere containing the antenna and β is the propagation factor. Increased gain thus requires a physically larger antenna, while communications equipment manufacturers and users continue to demand physically smaller antennas. As a further constraint, to simplify the system design and packaging, and strive for a minimum cost, equipment designers and system operators prefer to utilize antennas capable of efficient multi-band and/or wide bandwidth operation, allowing the communications device to access various wireless services operating within different frequency bands from a single antenna. Finally, gain is limited by the known relationship between the antenna frequency and the effective antenna length (expressed in wavelengths). That is, the antenna gain is constant for all quarter wavelength antennas of a specific geometry i.e., at that operating frequency where the effective antenna length is a quarter wavelength of the operating frequency.

The known Chu-Harrington relationship relates the size and bandwidth of an antenna. Generally, as the size decreases the antenna bandwidth also decreases. But to the contrary, as the capabilities of handset communications devices expand to provide for higher data rates and the reception of bandwidth intensive information (e.g., streaming video), the antenna bandwidth must be increased.

One basic antenna commonly used in many applications today is the half-wavelength dipole antenna. The radiation pattern is the familiar omnidirectional donut shape with most of the energy radiated uniformly in the azimuth direction and little radiation in the elevation direction. Frequency bands of interest for certain communications devices are 1710 to 1990 MHz and 2110 to 2200 MHz. A half-wavelength dipole antenna is approximately 3.11 inches long at 1900 MHz, 3.45 inches long at 1710 MHz, and 2.68 inches long at 2200 MHz. The typical antenna gain is about 2.15 dBi. Clearly, such antennas are not acceptable for handheld communications devices.

The quarter-wavelength monopole antenna placed above a ground plane is derived from a half-wavelength dipole. The physical antenna length is a quarter-wavelength, but when operating over the ground plane the antenna performance resembles that of a half-wavelength dipole. Thus, the radiation pattern for a monopole antenna above a ground plane is similar to the half-wavelength dipole pattern, with a typical gain of approximately 2 dBi.

The common free space (i.e., not disposed above a ground plane) loop antenna (with a diameter of approximately one-third an operating wavelength) also displays the familiar donut radiation pattern along the radial axis, with a gain of approximately 3.1 dBi. At 1900 MHz, this antenna has a diameter of about 2 inches. The typical loop antenna input impedance is 50 ohms, providing good matching characteristics to conventional transmission lines. However, conventional loop antennas are too large for handset applications and do not provide multi-band operation. As the loop length increases (i.e., approaching one free-space wavelength), the maximum of the field pattern shifts from the plane of the loop to the axis of the loop. Placing the loop antenna above a ground plane generally increases its directivity.

Printed or microstrip antennas are constructed using patterning and etching techniques common in printed circuit board processing, with an upper metallization layer serves as the radiating element. These antennas are popular because of their low profile, the ease with which they can be fabricated and a relatively low fabrication cost. One such antenna is the patch antenna, comprising in stacked relation, a ground plane, a dielectric substrate and a radiating element. The patch antenna provides directional hemispherical coverage with a gain of approximately 3 dBi. Although small compared to a quarter or half wavelength antenna, the patch antenna has a relatively poor radiation efficiency, i.e., the resistive return losses are relatively high within its operational bandwidth. Disadvantageously, the patch antenna also exhibits a relatively narrow bandwidth. Multiple patch antennas can be stacked in parallel planes or spaced-apart in a single plane to synthesize a desired antenna radiation pattern that may not be achievable with a single patch antenna.

Given the advantageous performance of quarter and half-wavelength antennas, conventional antennas are typically constructed so that the antenna length is on the order of a half wavelength of the radiating frequency or a quarter wavelength with the antenna operated above a ground plane. These dimensions allow the antenna to be easily excited and operated at or near a resonant frequency, limiting the energy dissipated in resistive losses and maximizing the transmitted energy. But, as the operational frequency increases/decreases, the operational wavelength correspondingly decreases/increases. Since the antenna is designed to present a dimension that is a quarter or half wavelength at the operational frequency, when the operational frequency changes, the antenna is no longer operating at a resonant condition and antenna performance deteriorates.

As can be inferred from the above discussion of various antenna designs, each exhibits known advantages and disadvantages. The dipole antenna has a reasonably wide bandwidth and a relatively high antenna efficiency (gain). The major drawback of the dipole, when considered for use in personal wireless communications devices, is its size. At an operational frequency of 900 MHz, the half-wave dipole comprises a linear radiator of about six inches in length. Clearly it is difficult to locate such an antenna in the small space envelope of today's handheld communications devices. By comparison, the patch antenna or the loop antenna over a ground plane present a lower profile resonant device than the dipole, but operates over a narrower bandwidth with a highly directional radiation pattern. Thus placing an antenna proximate the ground plane of a printed circuit board that carries electronic components associated with operation of the communications device degrades performance of the antenna, especially lowering the antenna bandwidth.

As discussed above, multi-band or wide bandwidth antenna operation is especially desired for use with various personal or handheld communications devices. One approach to producing an antenna having multi-band capability is to design a single structure (such as a loop antenna) and rely upon the higher-order resonant frequencies of the structure to obtain a radiation capability in a higher frequency band. Another method employed to obtain multi-band performance uses two separate antennas, placed in proximity, with coupled inputs or feeds according to methods well known in the art. Each of the two separate antennas resonates at a predictable frequency to provide operation in at least two frequency bands, at the expense of consuming a greater volume within the communications handset. Thus it remains difficult to realize an efficient antenna or antenna system that satisfies the multi-band/wide bandwidth operational features in a relatively small physical volume.

The "hand" or "body" effect must also be considered during the design of antennas for handheld communications devices. Although an antenna incorporated into such devices is designed and constructed to provide certain ideal performance characteristics, in fact all of the performance characteristics are influenced, some significantly, by the proximity of the user's hand or body to the antenna when the communications device is in use. When the hand of a person or other grounded object is placed close to the antenna, stray capacitances are formed between the effectively grounded object and the antenna. This capacitance can significantly detune the antenna, shifting the antenna resonant frequency (typically to a lower frequency), thereby reducing the received or transmitted signal strength. It is impossible to accurately predict and design the antenna to ameliorate these effects, as each user handles and grasps the personal communications device differently.

Recently, cellular handsets have been designed to operate in three frequency bands: 824–894 MHz (AMPS/CDMA) or 880–960 MHz (GSM) and 1710–1880 MHz (DCS) and 1850 MHz–1990 MHz (PCS). There is, however, a desire to have a handset antenna capable of functioning anywhere in the world. Ideally, such a handset comprises a single antenna that supports all four frequency bands identified above. In addition, use of one antenna design reduces antenna inventory requirements for different cellular telephones operative in different frequency bands.

Prior art antennas cannot operate in each of the four listed bands. Broadband antennas (providing continuous coverage over all frequency ranges of interest) are too large to be used in most if not all handsets being manufactured in the 2003–2004 period. Thus as can be seen, the various prior art antennas have certain advantageous features, but none offer all the performance requirements desired for handset and other wireless communications applications, including multi-band operation, high radiation efficiency, wide bandwidth, high gain, low profile and low fabrication cost.

BRIEF SUMMARY OF THE INVENTION

According to one embodiment of the present invention, an antenna operative in a plurality of spaced-apart frequency bands comprises a feed, a first resonator conductively connected to the feed, a second resonator substantially parallel to the first resonator, a resonating meanderline having an axis substantially parallel to the first and the second resonators and comprising segments, a counterpoise and a ground return conductively connected to the counterpoise and to one or more segments of the meanderline, wherein coupling between one or more of the first resonator, the second resonator and the resonating meanderline causes the antenna to operate in the plurality of spaced-apart frequency bands.

BRIEF DESCRIPTION OF THE DRAWINGS

The present invention can be more easily understood and the advantages and uses thereof more readily apparent when the following detailed description of the present invention is read in conjunction with the figures wherein.

In accordance with common practice, the various described features are not drawn to scale, but are drawn to emphasize specific features relevant to the invention. Reference characters denote like elements throughout the figures and text.

DETAILED DESCRIPTION OF THE INVENTION

Figure 1:
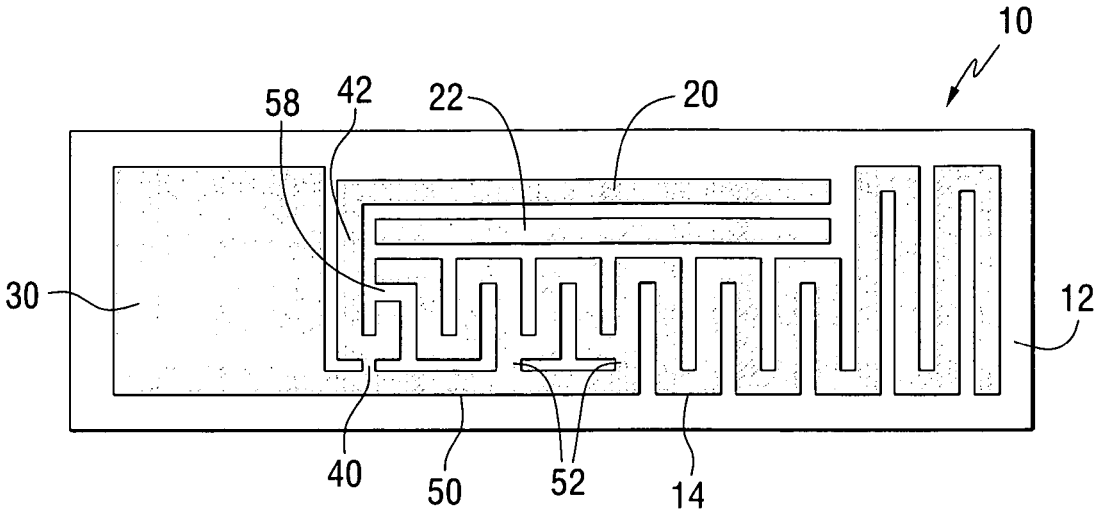
FIG. 1 illustrates an antenna constructed according to the teachings of the present invention.

Before describing in detail the particular antenna apparatus according to the present invention, it should be observed that the present invention resides primarily in a novel and non-obvious combination of elements. So as not to obscure the disclosure with details that will be readily apparent to those skilled in the art, certain conventional elements and steps have been presented with lesser detail, while the drawings and the specification describe in greater detail other elements and steps pertinent to understanding the invention.

Manufacturers of current and emerging handset communications devices desire embedded antenna solutions covering the four common frequency ranges or bands as set forth above. The present invention employs techniques, based on a combination of coupling and conductive effects among the antenna elements that provide efficient antenna radiation over the required frequency ranges. Further, these performance characteristics are not substantially impacted by the hand or body effect nor by various handset components that can operate as a counterpoise for the antenna. As is known in the art, interaction between certain handset components (especially the printed circuit board ground plane) and the antenna can substantially reduce the operating bandwidth, especially the bandwidth of low resonant frequencies. This effect is substantially diminished in the antenna of the present invention, as a sufficiently broad low frequency bandwidth is provided. It is recognized by those skilled in the art that in certain applications and when operative with certain handsets one or more of the size, geometry, location.

Generally, according to one embodiment of the present invention, the antenna size is about 42–44 mm×12–14 mm in length and width, and in one embodiment extends about 6.5 to 7 mm above a printed circuit board to which the antenna is attached. In another embodiment, the antenna is coplanar with the printed circuit board (PCB). As is known, other components required for operation of the communications device may be mounted on the PCB. Antenna performance does not substantially differ between these two embodiments. In yet another embodiment, the antenna is disposed over a ground plane within the PCB, with little impact on the antenna resonant frequencies, but with some narrowing of the bandwidths.

The subject invention uses a double resonance (i.e., two relatively close resonant frequencies with overlapping operating bandwidths) provided by two high band resonating elements (comprising in one embodiment, two substantially parallel conductive strips disposed on an insulating substrate, such as printed circuit board material) to achieve a relatively low VSWR in the frequency range of about 1710–2000 MHz, while providing radiation efficiency of over 50%. This frequency range of 1710–2000 MHz encompasses the DCS band of about 1710–1880 MHz and the PCS band of about 1850 MHz–1990 MHz.

For operation in the lower frequency bands of about 824 to 960 MHz (including the AMPS/CDMA band of about 824–894 MHz and the GSM band of about 880–960 MHz) the antenna of the present invention employs a single resonator or resonating element that provides a sufficiently wide bandwidth to encompass both the AMPS/CDMA and GSM bands. Operation of the low band resonator is influenced by coupling to the two high band resonating elements described above. This coupling tends to load the low band resonator thereby broadening the low frequency bandwidth.

Additionally, within the low frequency band, shunt impedance taps from the low band resonating element to ground (via a ground return region) improve the impedance match between an antenna feed and the signal processing components to which it is connected. These taps (i.e., a plurality of shunts to an approximate RF ground impedance of the counterpoise) aid in achieving wider bandwidth performance.

Antenna efficiency is nominally greater than about 50% to 60% over all frequency bands, while maintaining a VSWR of less than about 3:1 when operated either in free space or affixed to a PCB of a communications handset (where the PCB includes a ground plane, but the antenna is not disposed over the ground plane). In the embodiment where the antenna overlies the ground plane the VSWR increases slightly and the efficiency decreases slightly.

An antenna 10 constructed according to one embodiment of the present invention is illustrated in FIG. 1. The antenna 10 comprises a PCB 12 with a single-sided conductive pattern disposed thereon, the pattern comprising a low band resonator 14 further comprising a meanderline radiating section (for the two lower frequency bands) coupled through capacitive and magnetic effects to high band resonators 20 and 22 (represented by two parallel spaced apart conductive strips) for the two upper frequency bands and a counterpoise ground region 30. A material of the PCB 12 comprises a rigid or a flexible material.

An antenna feed 40 is conductively connected to the high band resonator 20 through an L-shaped element 42. Those skilled in the art recognize that the feed 40 can be relocated to other locations on other conductive structures of the antenna 10, including to another point on the L-shaped element 42. A capacitor disposed at a location 58 couples the feed 40 to the low band resonator 14. Thus the high band resonator 20 and the low band resonator 14 are fed in parallel from the feed 40.

A ground return region 50, a substantially linear element oriented parallel to the axis of the meanderline, extends from the counterpoise region 30 and is conductively connected to one or more meanderline segments of the meanderline low band resonator 14 at locations referred to as shunt impedance taps 52. Two such connections are illustrated in FIG. 1. Other embodiments comprise more or fewer shunt impedance taps. Yet other embodiments comprise shunt impedance taps at locations on the meanderline low band resonator 14 different from those illustrated. The number and location of these impedance taps affect the VSWR of the low resonant frequency band.

As shown in the illustrative embodiment of FIG. 1, the meanderline radiating section 14 comprises meanderline segments (undulating segments) having different heights, i.e., wherein a height is a distance between a lower leg of a meanderline segment and an upper leg of the segment. Three such different-height segments are illustrated in FIG. 1. In the embodiment illustrated, an axis of the meanderline radiating segment 14 is parallel to the high band resonators 20 and 22.

Capacitive and magnetic coupling between the segments of the meanderline low band resonator 14 and the high band resonators 20 and 22 cause the antenna to exhibit the desired performance characteristics as described herein. A meanderline radiating section having more or fewer meanderline segments changes the resonant frequency of the low frequency bands in accordance with a change in a length of the meanderline radiating section.

Figure 2:
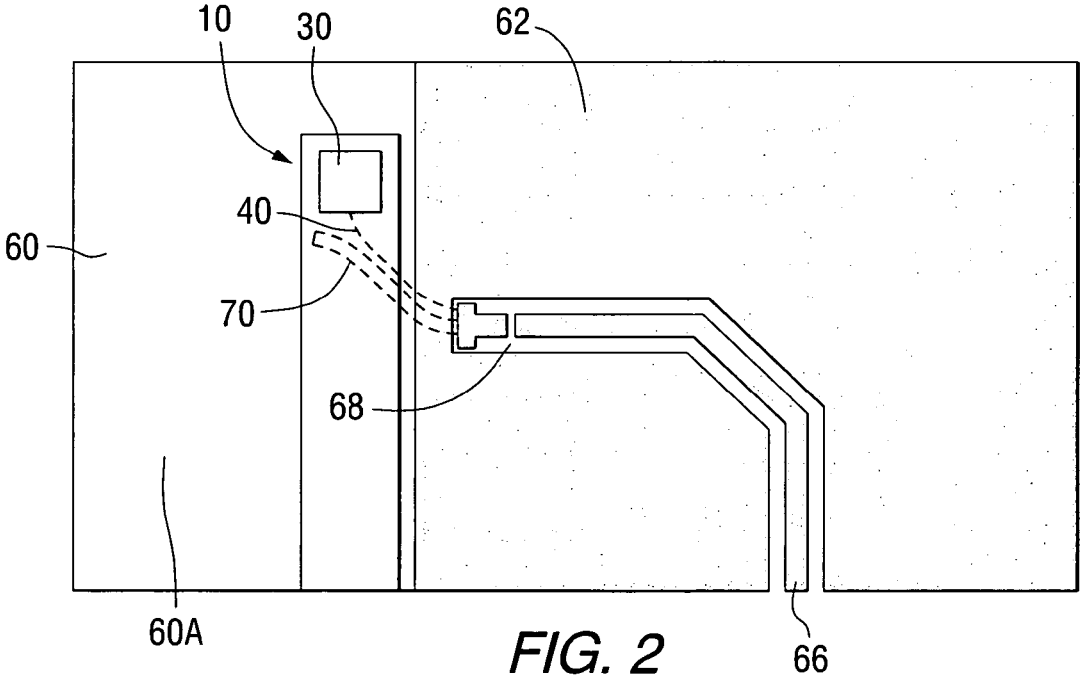
FIG. 2 illustrates the antenna of FIG. 1 operative with a first ground plane.

In one embodiment, the antenna 10 is mounted overlying a PCB substrate 60 with a ground plane 62 disposed thereon, with the ground plane extending in a direction away from the antenna 10 as illustrated in FIG. 2. For simplicity, the various conductive elements of the antenna 10 are not illustrated in FIG. 2. As can be seen, in this embodiment the ground plane 62 does not extend under the antenna 10, instead a PCB region 60A devoid of conductive ground plane material is disposed under the antenna 10. In this embodiment the antenna 10 extends about 6.5 to 7 mm above the region 60A, with air or another dielectric material disposed in this region.

Typically, the ground plane 62 of FIG. 2 is formed as an intermediate or buried layer within the PCB substrate 60. Electronic components can be mounted on either surface of the PCB substrate 60 and connected to interconnecting conductive traces formed on an opposing surface of the PCB substrate 60. As is known to those skilled in the art, the ground plane 62 is shaped to avoid unwanted contact with the electronic components mounted on the PCB substrate 60 and the interconnecting conductive traces. In another embodiment, the ground plane 62 is disposed on one or both of the top and bottom surfaces of the PCB 60 (the bottom surface not visible in FIG. 2) with interconnecting conductive vias extending therebetween for top and bottom surface ground planes.

A conventional microstrip feed line 66 on the PCB 60 is also illustrated in FIG. 2. One embodiment further comprises an electrical open 68 in the microstrip feed 66 for receiving electronic components (e.g., a capacitor and/or an inductor) that bridge the open 68 for matching a feed impedance to an antenna input impedance. A coaxial feed line signal conductor 70 extends from the microstrip feed line 66 under the antenna 10 to the feed 40 (see FIGS. 1 and 2). A ground conductor 72 of the coaxial feed line conductor 70 extends from the ground plane 62 to the counterpoise 30.

Figure 3:
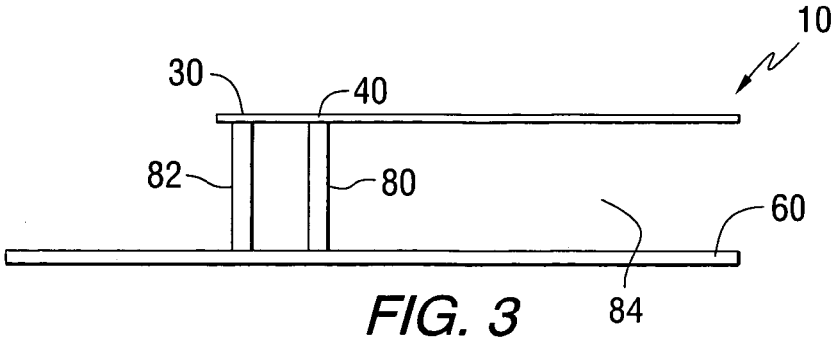
FIGS. 3 and 4 illustrate structures for connecting the antenna of FIG. 1 to a feed and a ground.

In another embodiment of FIG. 3, a microstrip feed line extends under the antenna 10, and the coaxial feed line conductor 70 and ground conductor 72 are replaced by a conductive signal post 80 and a conductive ground post 82. The signal post 80 is electrically connected to the microstrip feed line and extends upwardly from the PCB 60 for electrical connection to the antenna feed 40. The ground post 82 is electrically connected to the ground plane 62 and extends upwardly therefrom to the antenna 10 for electrical connection to the counterpoise 30. A gap region 84 comprises air or another dielectric material.

Figure 4:
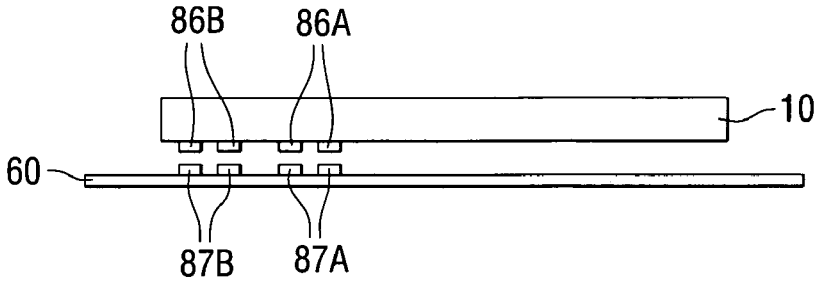

In yet another embodiment of FIG. 4, one or more feed fingers 86A and ground fingers 86B extend from a bottom surface of the antenna 10, for conductively mating with associated feed fingers 87A and ground fingers 87B, to effect connection of the feed 40 and the counterpoise 30 to, respectively, feed line 66 and the ground plane 62. In this embodiment it may be desired to relocate the feed connection and the counterpoise connection to an edge of the antenna proximate the ground plane 62 of FIG. 2.

In another embodiment (not illustrated), ground plane material is disposed in the region 60A of the PCB 60, that is, the antenna 10 overlies the ground plane. As described above, this orientation produces different performance characteristics compared to embodiments in which the antenna is not disposed over a ground plane. A gap defined between the antenna 10 and the underlying ground region comprises air or another dielectric material.

Figure 5:
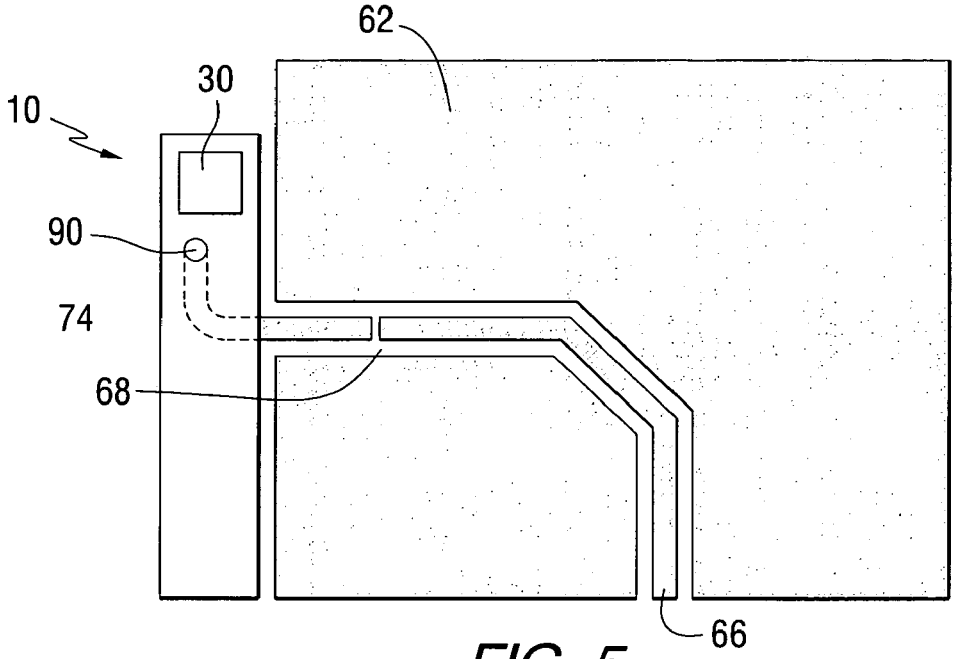
FIG. 5 illustrates the antenna of FIG. 1 operative with a second ground plane.

FIG. 5 illustrates another embodiment of the present invention wherein the antenna 10 is disposed substantially coplanar with the PCB substrate 60. For simplicity only the counterpoise 30 is illustrated. The microstrip feed line 66 extends under the antenna 10 for connection to the feed 40 through a conductive via 90 as is known in the art. Alternatively, a wire or post connection can be employed.

Figure 6:
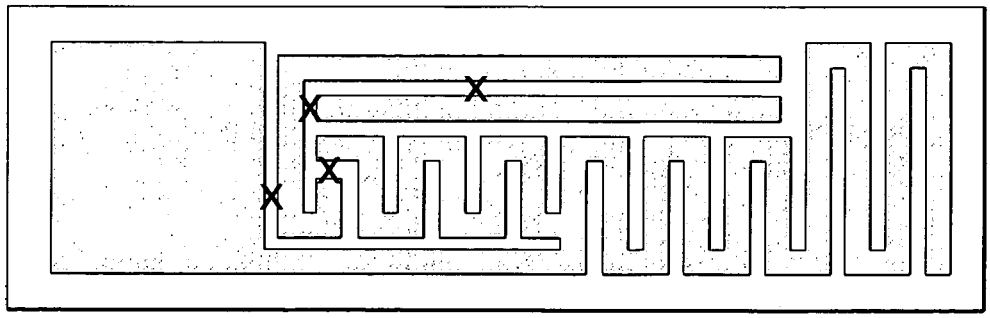
FIG. 6 illustrates regions for connecting capacitors across various elements of the antenna of FIG. 1.

To improve the impedance matching and coupling characteristics and balance current flow in the antenna elements, in one embodiment, discrete capacitors are disposed at one or more locations to interconnect two antenna elements. Potential advantageous locations for the capacitors are represented with an "X" in FIG. 6. In lieu of discrete capacitors, interdigital finger capacitors can be printed on the antenna PCB to provide the desired capacitance. One or more of the capacitance values can be modified to effect one or more of the resonant frequencies of the antenna 10. Typically, as the capacitance is increased, the resonant frequency falls.

Figure 7:
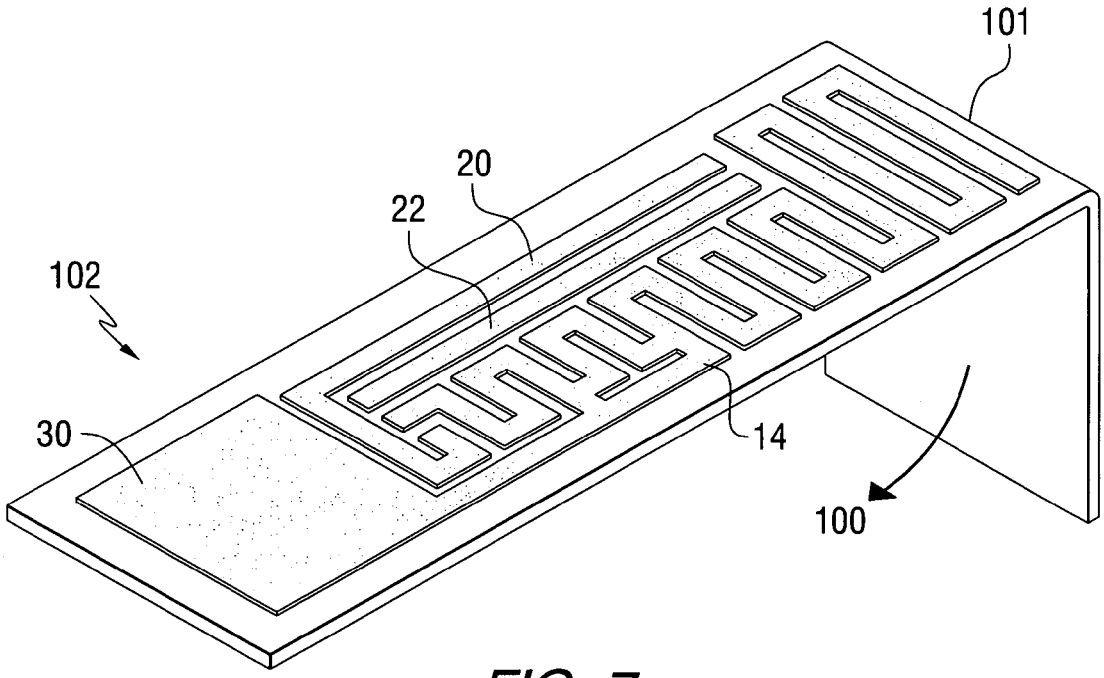
FIG. 7 illustrates another embodiment of an antenna constructed according to the teachings of the present invention.

As shown in FIG. 7, a conductive low band tuning end plate 100 is conductively connected to the meanderline low band resonator 14 and extends from an end 101 of the antenna 102 downwardly in a direction toward the PCB to which the antenna is attached. Modifying a size of the tuning end plate 100 and its distance to the ground pane 62 changes certain antenna operating parameters, including lowering the low band resonant frequencies. In another embodiment, a tuning end plate is coplanar with the antenna 102 rather than perpendicular to the antenna 102 as illustrated in FIG. 7.

The counterpoise 30 and the various impedance matching components of the antenna of the present invention can be adjusted to provide compromise VSWRS for the upper and lower operating frequency bands. Low frequency tuning to a band center near 900 MHz can be achieved by adjusting a distance between the tuning end plate 100 and the ground plane 62 on the PCB 60. Low band resonance is determined primarily by the meanderline electrical length, according to computations that are well known in the art. A resonant bandwidth sufficient to cover both of the two low operating bands (about 824 to 960 MHz, including the AMPS/CDMA band of about 824–894 MHz and the GSM band of about 880–960 MHz) is partially due to coupling of the meanderline radiator 14 to the high band resonators 20 and 22, the counterpoise 30 and the shunt impedance taps 52.

The closely spaced high-band resonances are due to magnetic and capacitive coupling to the feed 40 and segments of the meanderline radiator 14 and the interaction of the two high band radiating elements 20 and 22.

Figure 8:
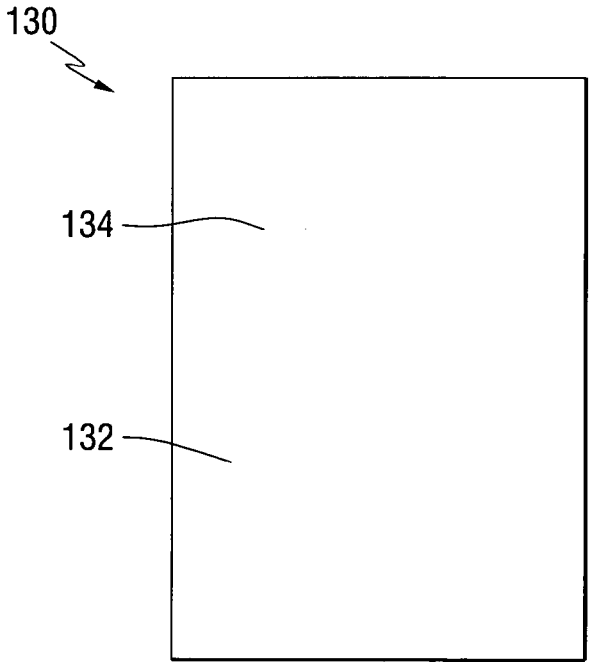
FIG. 8 comprises a communications device with which an antenna constructed according to the teachings of the present invention can be operative.

FIG. 8 illustrates a conventional communications device handset 130 comprising a printed circuit board region 132 further comprising a printed circuit board, including a ground plane and various electronic components associated with operation of the handset 130. An antenna, such as an antenna constructed according to the teachings of the present invention is disposed generally within an antenna region 134. These regions designations are intended to generally indicate the location of the printed circuit board region 132 and the antenna region 134, as those skilled in the art recognize that other locations for the printed circuit board and the antenna are possible and may be desirable in certain handset communications devices. Typically, a keyboard is disposed overlying the printed circuit board region 132.

The antenna of the present invention is suitable for use in a communications device requiring the capability to operate over a broad frequency range or within several distinct frequency bands, notwithstanding the proximity to a PCB ground structure 62 and other components of a handset or other communications device.

The dimensions, shapes and relationships of the various antenna elements and their respective features as described herein can be modified to permit operation in other frequency bands with other operational characteristics, including bandwidth, radiation resistance, input impedance, radiation efficiency, etc. The antenna may also be scalable to other resonant frequencies by dimensional variation. A combination of appropriately spaced conductive elements provides quad band performance created by multiple resonances, for example, two closely-space resonant frequencies in the high band and one broad resonant frequency in the low band.

An antenna architecture has been described as useful for providing operation in four frequency bands. While specific applications and examples of the invention have been illustrated and discussed, the principals disclosed herein provide a basis for practicing the invention in a variety of ways and in a variety of antenna configurations. Numerous variations are possible within the scope of the invention. The invention is limited only by the claims that follow.

What is claimed is:

1. An antenna operative in a plurality of spaced-apart frequency bands, comprising:

a feed;

a first resonator conductively connected to the feed;

a second resonator substantially parallel to the first resonator;

a resonating meanderline having an axis substantially parallel to the first and the second resonators and comprising segments;

a counterpoise;

a ground return conductively connected to the counterpoise and to one or more segments of the meanderline; and wherein coupling between one or more of the first resonator, the second resonator and the resonating meanderline causes the antenna to operate in the plurality of spaced-apart frequency bands.

2. The antenna of claim 1 wherein the first resonator, the second resonator, the resonating meanderline, the counterpoise and the ground return each comprises a conductive region disposed on a dielectric substrate.

3. The antenna of claim 1 wherein the first resonator comprises a conductive strip having a parallel spaced-apart orientation with the second resonator, also comprising a conductive strip.

4. The antenna of claim 1 wherein the ground return comprises a linear element oriented parallel to the axis of the meanderline.

5. The antenna of claim 1 wherein the coupling comprises one or both of magnetic coupling and capacitive coupling.

6. The antenna of claim 1 wherein the plurality of spaced-apart frequency bands comprise a double resonance high frequency band and a single resonance low frequency band.

7. The antenna of claim 6 wherein the high frequency band comprises a frequency band between about 1710 and 2000 MHz and the low frequency band comprises a frequency band between about 824 and 960 MHz.

8. The antenna of claim 1 further comprising a capacitor connected between the feed and a terminal end of the resonating meanderline.

9. The antenna of claim 1 further comprising a conductive region extending from a last segment of the meanderline.

10. The antenna of claim 9 wherein the conductive region is coplanar with the meanderline.

11. An antenna operative in a plurality of spaced-apart frequency bands, comprising:

a ground region;

a meanderline conductively connected to the ground region and resonant at a first frequency so as to produce a first low frequency operational bandwidth about the first frequency;

a first resonating element;

a second resonating element, the first and second radiating elements spaced apart from and lacking a conductive connection to the ground region; and wherein an interaction of the first and the second resonating elements produces a resonance at a second and a third frequency, and wherein a second operational bandwidth about the second frequency overlaps a third operational bandwidth about the third frequency to produce a high frequency operational bandwidth.

12. The antenna of claim 11 wherein the meanderline conductively connected to the ground region comprises a plurality of meanderline segments conductively connected to the ground region.

13. The antenna of claim 11 further comprising a feed conductively connected to the first resonating element.

14. The antenna of claim 11 further comprising a plurality of capacitors each connected between two of the ground region, the meanderline, the first resonating element and the second resonating element.

15. The antenna of claim 11 wherein the antenna is formed on a substrate wherein the ground region is disposed in a region defined by first and second parallel edges of the substrate, the meanderline is disposed proximate the first edge and the first and the second resonating elements are disposed proximate the second edge.

16. The antenna of claim 11 wherein the antenna is disposed over a substrate comprising a ground plane conductively connected to the ground region.

17. The antenna of claim 11 disposed overlying a substrate further comprising a first and a second region, wherein the first region comprises a ground plane, and wherein the antenna overlies the second region.

18. The antenna of claim 17 wherein the substrate comprises a signal feed line and the antenna further comprises a feed terminal conductively connected to the signal feed line.

19. The antenna of claim 18 wherein the signal feed line defines an electrical open therein, and wherein at least one of a capacitor and an inductor bridge the electrical open.

20. The antenna of claim 17 spaced apart from the second region to define a gap therebetween.

21. The antenna of claim 20 wherein a dielectric material is disposed within the gap.

22. The antenna of claim 11 wherein the first resonating element comprises a first linear conductive strip and the second resonating element comprises a second linear conductive strip parallel to the first conductive strip.

23. The antenna of claim 11 further comprising a conductive region extending from a last segment of the meanderline.

24. The antenna of claim 23 wherein the conductive region is coplanar with the meanderline.

25. An antenna comprising:

a rectangular substrate defined by first and second spaced apart short edges connected by first and second spaced apart long edges, a substantially rectangular counterpoise disposed proximate the first short edge;

first and second substantially parallel strips disposed substantially parallel to and proximate the first long edge;

a meanderline disposed proximate the second long edge and having an axis substantially parallel to the second long edge, and wherein the meanderline comprises a plurality of undulating segments of at least two different heights;

a feed conductively connected to the first strip; and a capacitor connecting the feed to an end of the meanderline.

26. The antenna of claim 25 wherein at least two of the undulating segments are disposed proximate the second short edge such that the first and the second strips are disposed between the counterpoise and the at least two of the undulating segments.

27. The antenna of claim 25 further comprising a ground return conductor extending from the counterpoise along the second edge and conductively connected to one or more of the undulating segments of the meanderline.

28. A communications handset comprising a substrate having electronic components mounted thereon and further comprising a ground region;

an antenna operative with the electronic components for radiating a signal or receiving a signal in a plurality of spaced-apart frequency bands, the antenna comprising:

a feed;

a first resonator conductively coupled to the feed;

a second resonator substantially parallel to the first resonator;

a resonating meanderline having an axis substantially parallel to the first and the second resonators and comprising segments;

a counterpoise disposed proximate a first end of the resonating meanderline and connected to the ground region;

a ground return conductively connected to the counterpoise, extending from the counterpoise and connected to one or more segments of the meanderline; and wherein coupling between one or more of the first resonator, the second resonator and the resonating meanderline causes the antenna to operate in the plurality of spaced-apart frequency bands.

29. The communications handset of claim 28 further comprising structural components including a handset case, wherein certain of the structural components are connected to the ground region.

30. The communications handset of claim 28 wherein the coupling comprises one or both of magnetic coupling and capacitive coupling.

31. The antenna of claim 28 wherein the plurality of spaced-apart frequency bands comprise a double resonance high frequency band and a single resonance low frequency band.

32. The antenna of claim 31 wherein the high frequency band comprises a frequency band between about 1710 and 2000 MHz and the low frequency band comprises a frequency band between about 824 and 960 MHz.

33. The antenna of claim 28 further comprising a conductive region extending from a second end of the meanderline.

34. The antenna of claim 33 wherein the conductive region is coplanar with the meanderline.

* * * * *